US005984633A

United States Patent [19]

Bachinger et al.

[11] Patent Number: 5,984,633

[45] Date of Patent: Nov. 16, 1999

[54] GUIDE DEVICE FOR A TURBINE WITH A GUIDE-BLADE CARRIER AND METHOD FOR PRODUCING THE GUIDE DEVICE

[75] Inventors: Werner Bachinger, Rednitzhembach; Peter Clement, Cadolzburg, both of Germany

[73] Assignee: ABB Patent GmbH, Mannheim, Germany

[21] Appl. No.: 08/917,576

[22] Filed: Aug. 20, 1997

Related U.S. Application Data

[63] Continuation of application No. PCT/EP96/05428, Dec. 5, 1996.

[30] Foreign Application Priority Data

Dec. 20, 1995 [DE] Germany ..... 195 47 653

[51] Int. Cl.[6] ..... F01D 9/04; F03B 1/04; F03B 11/02

[52] U.S. Cl. ..... 415/209.2; 415/209.2; 415/209.3; 415/209.4; 415/210.1; 415/208.2; 415/189; 415/190; 29/416; 29/412; 29/557; 29/558; 29/525.08; 29/889.21; 29/889.22; 29/525.1

[58] Field of Search ..... 415/209.2, 209.3, 415/209.4, 210.1, 208.2, 189, 190; 29/416, 412, 557, 558, 525.08, 889.21, 889.22, 525.1

[56] References Cited

U.S. PATENT DOCUMENTS

| | | | |
|---|---|---|---|
| 3,788,767 | 1/1974 | Bednarczyk et al. | 415/217 |
| 3,849,023 | 11/1974 | Klompas | 415/170 |
| 4,990,056 | 2/1991 | McClain et al. | 416/160 |
| 5,232,342 | 8/1993 | Thompson | 415/214.1 |
| 5,405,245 | 4/1995 | Cornelius | 416/215 |
| 5,743,711 | 4/1998 | Fournier et al. | 415/209.2 |

*Primary Examiner*—F. Daniel Lopez
*Assistant Examiner*—Rhonda Barton
*Attorney, Agent, or Firm*—Herbert L. Lerner; Laurence A. Greenberg

[57] ABSTRACT

A guide device for a turbine with a guide-blade carrier installed in a turbine housing, preferably the housing of a steam turbine, and equipped with guide blades, includes positioning elements for positioning and fastening the guide blades to the guide-blade carrier and for ensuring a specific installation position of the guide blades. In order to simplify the production of the guide device, two halves of a guide-blade ring divided in the region of a parting plane of the turbine housing serve as the positioning elements. Radially extending profile holes for inserting a guide-blade root of each guide blade are formed in the guide-blade ring. At least one first holding element is preferably releasable and in each case fixes the guide-blade root to the guide-blade ring. At least one second holding element retains each of the two halves of the guide-blade ring on the guide-blade carrier.

13 Claims, 3 Drawing Sheets

GUIDE DEVICE FOR A TURBINE WITH A GUIDE-BLADE CARRIER AND METHOD FOR PRODUCING THE GUIDE DEVICE

CROSS-REFERENCE TO RELATED APPLICATION

This application is a continuation of International Application Ser. No. PCT/EP96/05428, filed Dec. 5, 1996.

BACKGROUND OF THE INVENTION

FIELD OF THE INVENTION

The invention relates to a guide device for a turbine with a guide-blade carrier installed in a turbine housing, preferably the housing of a steam turbine, and equipped with guide blades, including positioning elements for positioning and fastening the guide blades to the guide-blade carrier and for ensuring a specific installation position of the guide blades. The invention also relates to a method for producing such a guide device with positioning elements which are provided for positioning and fastening guide blades to a guide-blade carrier and which ensure a specific installation position of the guide blades.

In order to guide the drive medium of a turbine, for example the steam in the case of a steam turbine, at the correct angle onto the moving blades, a guide device is used, having guide blades which are fixed in the so-called guide-blade carrier and are mounted, together with the guide-blade carrier, in the turbine housing. It is absolutely necessary, in that case, to ensure that the guide blades are installed in an exactly aligned position. So-called intermediate pieces have heretofore been used as positioning elements which allow such an exact positioning of the individual guide blades relative to one another. However, such intermediate pieces are extremely complicated to produce, since in the first place, two solid steel rings have to be brought to the appropriate dimensions by turning on a lathe and then have to be cut up in such a way as to produce a multiplicity of individual intermediate-piece blanks. Due to cutting losses, two steel rings are required for the intermediate pieces of a guide cascade. The intermediate-piece blanks then have to undergo careful machining of their bulging or convex side and rear side, in order to give them a shape by which two successive intermediate pieces form a free space that is suitable for receiving the guide-blade root belonging to the guide blade, and moreover also makes it possible to fix the root to the guide-blade carrier through the use of a special holding groove.

The complicated shape of the intermediate pieces not only makes them complicated to produce, but may also result in quality defects if the accuracy of fit demanded is not achieved. Losses of efficiency due to an outer contour which is not optimal are also possible and the reliability of the guide-blade fastening may suffer as a result of wash-outs in the region of gaps. However, production is made complicated not only in the case of the intermediate pieces, but also in the case of guide blades, for those too have to be provided with a holding groove, the dimensions of which must be coordinated exactly with the intermediate pieces.

SUMMARY OF THE INVENTION

It is accordingly an object of the invention to provide a guide device for a turbine with a guide-blade carrier and a method for producing the guide device, which overcome the hereinafore-mentioned disadvantages of the heretofore-known devices and methods of this general type and in which the guide device can be produced more simply, is distinguished by high reliability and quality and is also much easier to service.

With the foregoing and other objects in view there is provided, in accordance with the invention, a guide device for a turbine, comprising a guide-blade carrier installed in a turbine housing, preferably a housing of a steam turbine; guide blades having guide-blade roots; positioning elements for positioning and fastening the guide blades to the guide-blade carrier and for ensuring a specific installation position of the guide blades, the positioning elements including a guide-blade ring divided at a turbine housing parting plane into two guide-blade ring halves having radially extending profile holes formed therein for receiving the guide-blade roots; at least one first, preferably releasable, holding element fixing one of the guide-blade roots to the guide-blade ring; and at least one second holding element retaining the guide-blade ring halves on the guide-blade carrier.

The basic structure of the guide device is decisively simplified and a secure and reliable fastening of the guide blades in the turbine housing is provided. The fastening, where appropriate, is also particularly easy to service when removable first holding elements are used and they make it possible to exchange defective guide blades.

In accordance with another feature of the invention, the first holding elements are blade-holding pins, at least one of which penetrates axially from the side, in the region of the guide-blade root, through a corresponding bore into the guide-blade ring and into the guide-blade root and connects the two parts to one another. This provides an especially advantageous fastening of the guide blades to the guide-blade ring with regard to exchangeability. In the event of service, the blade-holding pin can be pulled or knocked out laterally and thus releases the guide blades for exchange.

In accordance with a further feature of the invention, the second holding elements are threaded ring-holding pins, at least one of which, starting from a sectional surface of the guide-blade ring in the region of the parting plane of the turbine housing, penetrates through a corresponding bore into the guide-blade ring and into the guide-blade carrier and connects the two parts to one another. In the event of service, this fastening also affords a possibility of exchange which is substantially easier than in the case of conventional welded connections so that, where appropriate, the complete guide-blade ring or one of its two halves can be exchanged.

In accordance with an added feature of the invention, each of the two halves of the guide-blade ring is penetrated at each of its two ends by a ring-holding pin in each case and is thus fixed on both sides.

A division of the guide-blade ring in the region of the parting plane presents problems when the guide blades follow one another so closely that their outer surfaces overlap one another in the axial direction. Therefore, in accordance with an additional feature of the invention, in order to avoid separating the guide blades, care is taken to ensure that the sectional surface which divides the guide-blade ring into two halves runs obliquely relative to the parting plane of the turbine housing in the middle between the outer contours of two adjacent profile holes.

In accordance with yet another feature of the invention, the free ends of the halves of the guide-blade ring which meet one another and are located in the region of the parting plane are beveled to avoid catching of butting edges when the two halves of the guide-blade ring are being assembled.

In accordance with yet a further feature of the invention, if the guide blades are disposed at an adequate distance from one another, it is sufficient if the sectional surface which divides the guide-blade ring into two halves runs parallel to the parting plane of the turbine housing between two adjacent profile holes.

In accordance with yet an added feature of the invention, the profile holes are produced through the use of wire erosion.

In accordance with yet an additional feature of the invention, the bores for receiving the blade-holding pins are passage holes which allow the blade-holding pins to engage on the guide-blade ring on both sides of the guide-blade root. In this way, the insertion of the blade-holding pins and primarily knocking them out, which is necessary in the event of service, is made easier.

In accordance with again another feature of the invention, the bores for receiving the ring-holding pins are blind holes.

In accordance with again a further feature of the invention, the depth of the profile holes is coordinated with the length of the guide-blade roots in such a way that the free end of the latter does not reach the end of the profile holes. This is essential for a simplified manufacturing sequence and dispenses with re-machining of the outer surface of the guide-blade ring. The re-machining is otherwise absolutely necessary in the case of projecting guide-blade roots prior to the fastening of the guide-blade ring to the guide-blade carrier.

With the objects of the invention in view there is also provided a method for producing a guide device for a turbine having positioning elements for positioning and fastening guide blades to a guide-blade carrier and for ensuring a specific installation position of the guide blades, which comprises initially finish-turning a profile ring to form a guide-blade ring; then forming profile holes in the guide-blade ring by wire erosion; inserting a guide-blade root of a respective guide blade into each profile hole; subsequently connecting the guide blades to the guide-blade ring by drilling passage holes and inserting blade-holding pins; and finally forming a parting plane by separating the guide-blade ring into two halves.

Other features which are considered as characteristic for the invention are set forth in the appended claims.

Although the invention is illustrated and described herein as embodied in a guide device for a turbine with a guide-blade carrier and a method for producing the guide device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
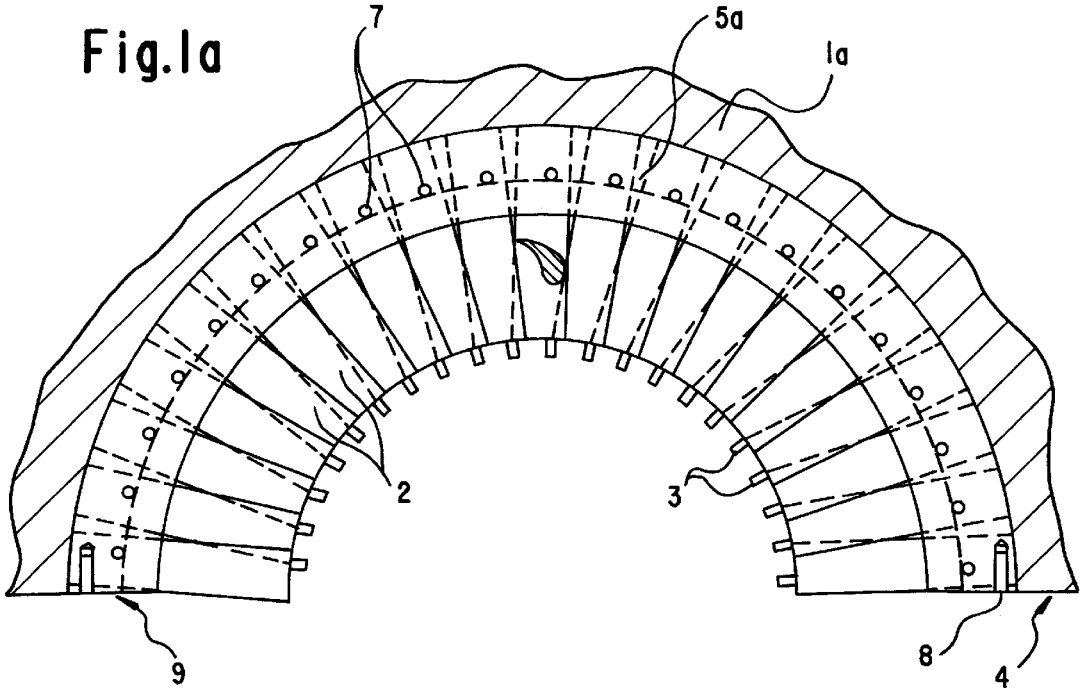
FIG. 1 is a fragmentary, diagrammatic, axially view of a guide device with two halves of a guide ring equipped with guide blades.
Figure 1B:
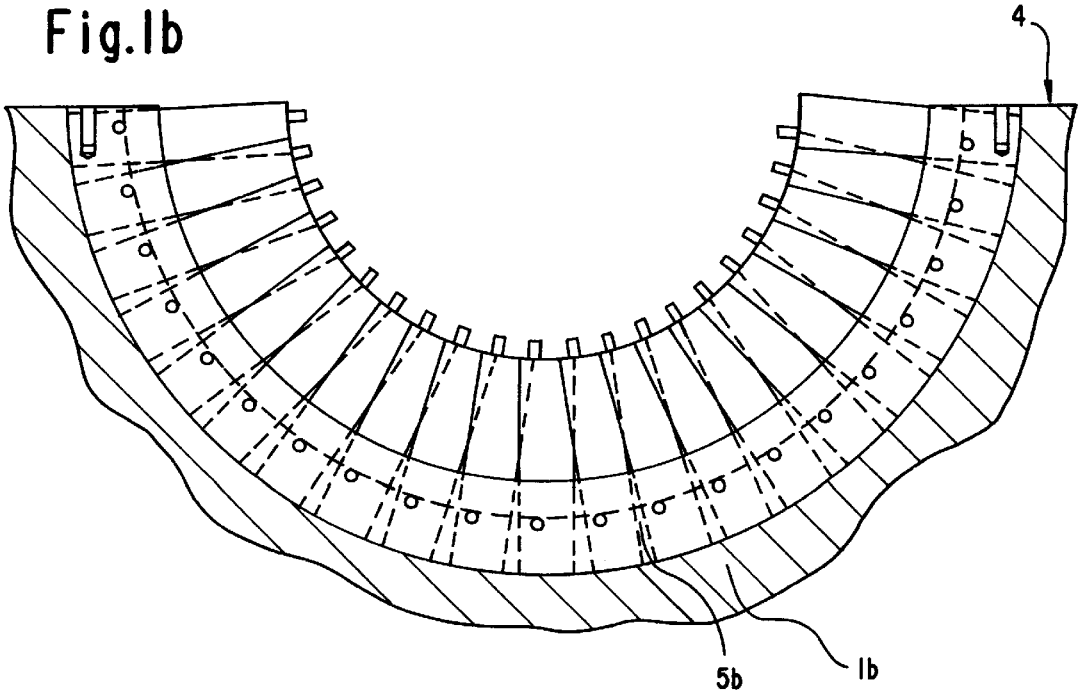

Referring now to the figures of the drawings in detail and first, particularly, to FIG. 1 thereof, there is seen an illustration of a guide device of a steam turbine which includes a guide-blade carrier having a guide-blade carrier top part 1*a* and a guide-blade carrier bottom part 1*b* that are separated from one another by a parting plane 4 of a turbine housing, preferably a steam turbine housing, in which the guide-blade carrier is installed. Two halves 5*a* and 5*b* of a guide-blade ring 5 are inserted with an exact fit in an annular groove of the guide-blade carrier 1*a*, 1*b*, with the annular groove being given corresponding dimensions. Guide blades 2 have a guide-blade root 6 and are fastened with the guide-blade root 6 and aligned exactly in position on the two halves 5*a*, 5*b* of the guide-blade ring 5 which serve as positioning elements for the guide blades. For this purpose, the guide-blade ring 5 is provided with profile holes which are coordinated with the profile of the guide-blade root 6 belonging to the guide blade 2, in such a way that an exact fit is ensured.

Figure 2A:
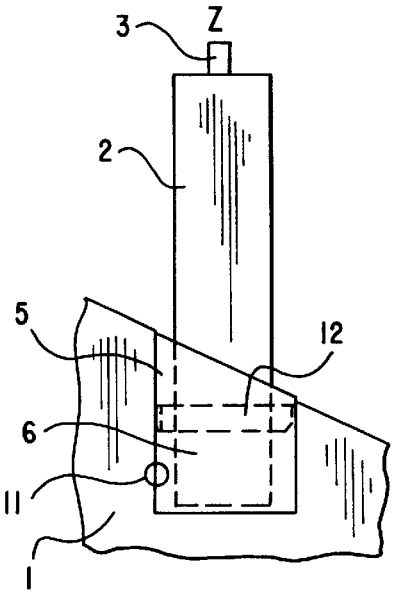
FIG. 2 is a fragmentary view of two mirror-symmetrical portions of the guide device in a region of a parting plane, firstly in a viewing direction Z and secondly in a viewing direction Y, according to FIG. 3.
Figure 2B:
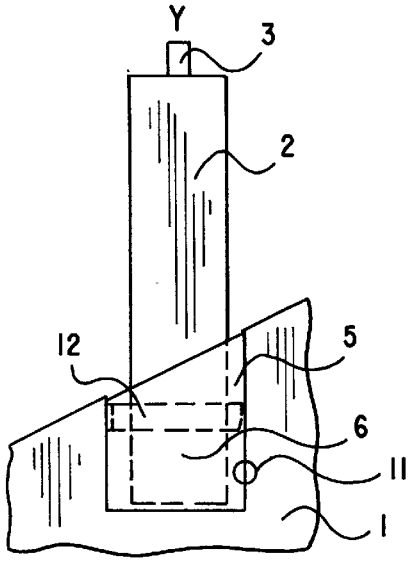
Figure 3A:
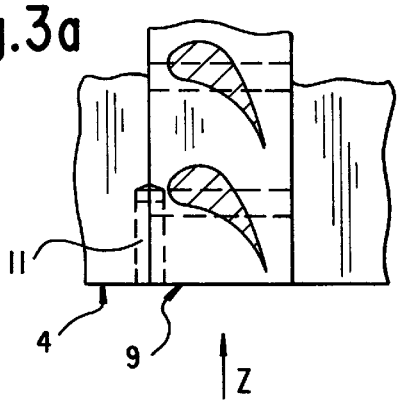
FIG. 3 is a fragmentary view of two sections through the guide blades, firstly along a sectional line C–D and secondly along a sectional line A–B according to FIG. 1, for a lower part of the guide device.
Figure 3B:
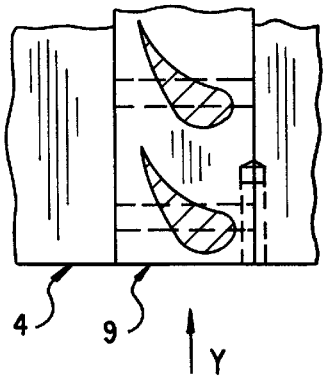
Figure 4A:
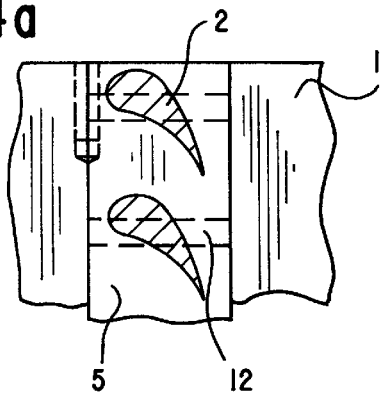
FIG. 4 is a fragmentary view of two sections through the guide blades, firstly along the sectional line C–D and secondly along the sectional line A–B according to FIG. 1 for an upper part of the guide device.
Figure 4B:
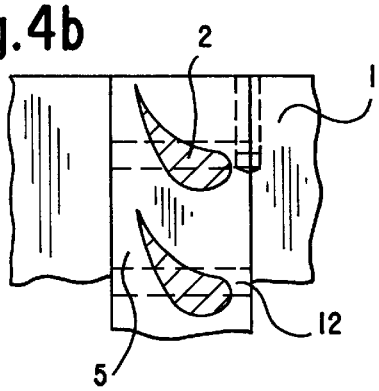

As is shown particularly in FIGS. 2 to 4, in order to fix the guide-blade roots 6 in the guide-blade ring 5, a passage hole 12 which passes through the guide-blade ring 5 and the guide-blade root 6 and which is suitable for inserting a blade-holding pin 7 extending laterally in the axial direction, is provided for each guide blade 2. Thus, if required, this pin can be knocked out or drilled out again in order to exchange a guide blade 2. Two free ends of the guide-blade ring 5 that face the parting plane 4 are each provided with a blind hole 11 which starts from the parting plane 4, runs obliquely relative to the latter and into which a ring-holding pin 8 is screwed. Elements 7 and 8 may be referred to as respective first and second holding elements.

In the present example according to FIGS. 1 to 4, as may be seen particularly in FIGS. 3 and 4, the guide-blade ring 5 is provided, in the region of the parting plane 4, with a sectional surface 9 running obliquely. This sectional surface 9, at the same time, runs centrally between outer surfaces of two adjacent guide blades 2, without touching one of these outer surfaces. However, if there were a sufficient distance between adjacent guide blades 2, the sectional surface 9 could also be in alignment with the parting plane 4. The oblique sectional surface 9 leads to butting edges at the free ends of the two halves 5*a*, 5*b* of the guide-blade ring 5. The butting edges could catch on one another when the top and bottom parts are being assembled and therefore they are beveled. The guide blades 2 have free ends with rivet studs 3, onto which a covering band with corresponding holes can be placed and riveted for the purpose of stabilizing the device.

Figure 5:
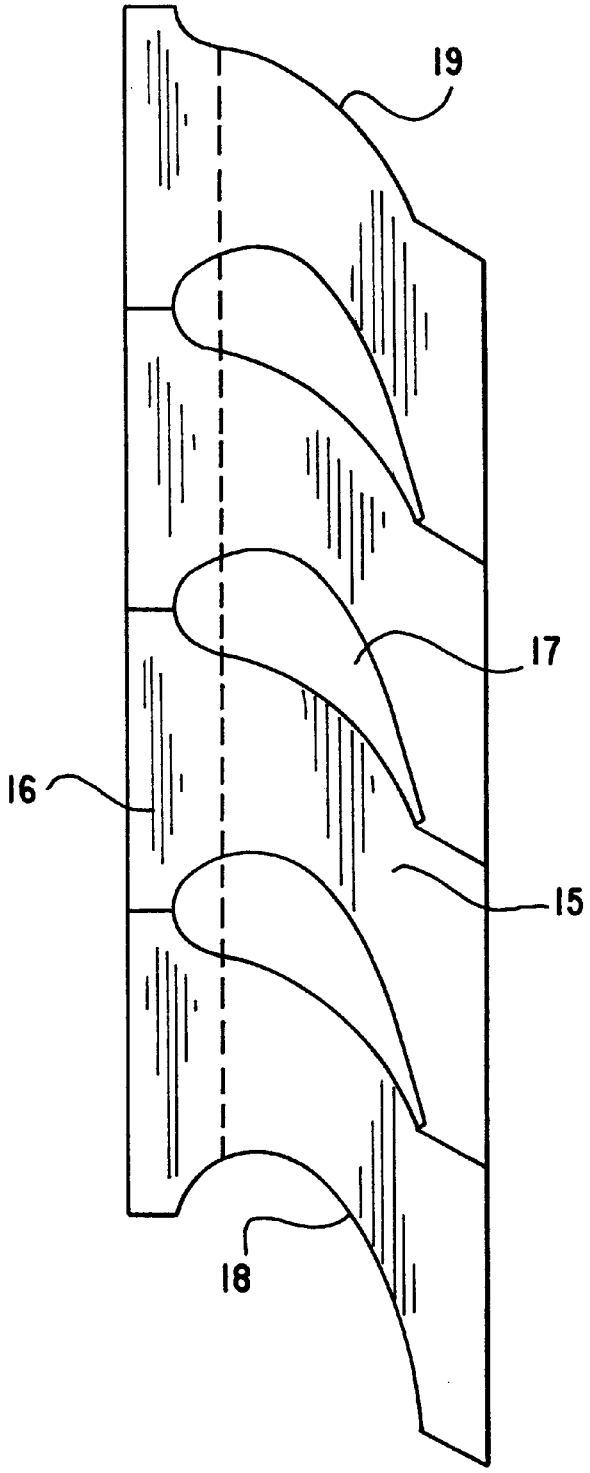
Fig.5 PRIOR ART
FIG. 5 is an elevational view showing a conventional structure of a guide device with intermediate pieces.

FIG. 5 serves to illustrate the difference from a conventional device, in which so-called intermediate pieces 15 serve as positioning elements. Intermediate-piece blanks are cut out from two lathe-turned rings and require intensive multi-sided machining. A bulging or convex side 18 on one hand, and a rear side 19 on the other hand, of two adjacent intermediate pieces 15, must be shaped in such a way as to form a profile recess 17 which is suitable for receiving a guide-blade root 6. Moreover, the intermediate pieces 15 are further provided with a holding groove 16 which is also continued in the guide-blade root 6 of the guide blade 2. The view in the illustration of FIG. 5 corresponds to that of FIGS. 3 and 4.

The method according to the invention for producing the guide device described herein requires only one ring which has to be finish-turned in order to produce the positioning elements. The profile holes are then cut out in this ring by the wire erosion method, and a guide-blade root can be anchored in each of the profile holes. For this purpose, the inserted guide blades 2, together with the guide-blade ring 5, are each provided with a passage hole 12, into which a blade-holding pin 7 is then inserted. The guide-blade ring 5 can then be separated into its two halves 5*a*, 5*b*.

We claim:

1. A guide device for a turbine, comprising:

a guide-blade carrier;

guide blades having guide-blade roots;

positioning elements for positioning and fastening said guide blades to said guide-blade carrier and for ensuring a specific installation position of said guide blades, said positioning elements including a guide-blade ring having a sectional surface and divided at a turbine housing parting plane into two guide-blade ring halves having radially extending profile holes formed therein for receiving said guide-blade roots;

at least one first holding element fixing one of said guide-blade roots to said guide-blade ring; and a plurality of ring-holding pins retaining said guide-blade ring halves on said guide-blade carrier, at least one of said ring-holding pins starting from said sectional surface in the vicinity of said turbine housing parting plane and penetrating through a corresponding bore into said guide-blade ring and into said guide-blade carrier and interconnecting said guide-blade ring and said guide-blade carrier.

2. The guide device according to claim 1, wherein said at least one first holding element is releasable.

3. The guide device according to claim 1, wherein said at least one first holding element is a blade-holding pin penetrating in the vicinity of said guide-blade root from the side through a corresponding bore into said guide-blade ring and into said guide-blade root and interconnecting said guide-blade ring and said guide-blade root.

4. The guide device according to claim 3, wherein said blade-holding pin penetrates through said bore in an axial direction.

5. The guide device according to claim 3, wherein said bore for receiving said blade-holding pin is a passage hole permitting said blade-holding pin to engage said guide-blade ring on both sides of said guide-blade root.

6. The guide device according to claim 3, wherein said guide-blade roots have free ends and a given length, and said profile holes have an end and a depth coordinated with said given length for preventing said free ends of said guide-blade roots from reaching said ends of said profile holes completely.

7. The guide device according to claim 1, wherein said guide-blade ring halves each have two ends penetrated by at least one of said ring-holding pins for fixing on both ends.

8. The guide device according to claim 1, wherein said profile holes are adjacent and have outer contours, and said sectional surface divides said guide-blade ring into said two guide-blade ring halves and runs obliquely relative to said turbine housing parting plane centrally between the outer contours of two adjacent profile holes.

9. The guide device according to claim 1, wherein said sectional surface divides said guide-blade ring into said two guide-blade ring halves and runs parallel to said turbine housing parting plane between two adjacent profile holes.

10. The guide device according to claim 1, wherein said bores for receiving said ring-holding pins are blind holes.

11. The guide device according to claim 1, wherein said guide-blade ring halves have free ends in the vicinity of said parting plane with beveled butting edges.

12. The guide device according to claim 1, wherein said profile holes are wire-eroded.

13. A method for producing a guide device for a turbine having positioning elements for positioning and fastening guide blades to a guide-blade carrier and for ensuring a specific installation position of the guide blades, which comprises:

initially finish-turning a profile ring to form a guide-blade ring;

then forming profile holes in the guide-blade ring by wire erosion;

inserting a guide-blade root of a respective guide blade into each profile hole;

subsequently connecting the guide blades to the guide-blade ring by drilling passage holes and inserting blade-holding pins;

forming a parting plane by separating the guide-blade ring into two halves;

forming at least one corresponding bore in the parting plane into the guide-blade ring and into a guide-blade carrier; and providing at least one guide-blade ring holding pin into the at least one bore starting from the parting plane to penetrate the guide-blade ring and the guide-blade carrier to securely interconnect the guide-blade ring and the guide-blade carrier.

* * * * *